United States Patent [19]

Martinak

[11] Patent Number: 4,507,013

[45] Date of Patent: Mar. 26, 1985

[54] DEVICE AND METHOD FOR REPAIR OF POT HOLES

[76] Inventor: Bonifac Martinak, 2939 S. Grove Ave., Berwyn, Ill. 60402

[21] Appl. No.: 157,072

[22] Filed: Jun. 6, 1980

[51] Int. Cl.[3] ..... E01C 7/00; E01C 23/09

[52] U.S. Cl. ..... 404/75; 404/70; 404/134

[58] Field of Search ..... 404/75, 73, 72, 70, 404/71, 134

[56] References Cited

U.S. PATENT DOCUMENTS

| | | | |
|---|---|---|---|
| 1,558,782 | 10/1925 | Bleecker | 404/72 X |
| 1,705,066 | 3/1929 | Sadtler | 404/72 X |
| 1,707,391 | 4/1929 | Fox | 404/75 |
| 2,934,452 | 4/1960 | Sternberg | 404/75 X |
| 3,344,608 | 10/1967 | McEachran | 404/75 X |
| 3,581,631 | 6/1971 | Samson | 404/75 |
| 3,699,854 | 10/1972 | Doherty | 404/73 |
| 3,853,417 | 12/1974 | Olsson | 404/90 |
| 3,915,582 | 10/1975 | Clarke | 404/75 |
| 4,074,948 | 2/1978 | Heater | 404/75 |
| 4,113,401 | 9/1978 | McDonald | 404/75 |

*Primary Examiner*—James A. Leppink
*Assistant Examiner*—Beverly E. Hjorth
*Attorney, Agent, or Firm*—Kemon & Estabrook

[57] ABSTRACT

Repair of pot holes in public roads, streets and highways is facilitated and improved by the use of a simple holding device which is firmly anchored in place in the pot hole before filling the hole with conventional road patching material which then permanently unites with the holding device.

8 Claims, 3 Drawing Figures

DEVICE AND METHOD FOR REPAIR OF POT HOLES

BACKGROUND OF THE INVENTION

As is common knowledge to practically everyone, the repair of pot holes or chuck holes as they are sometimes called, is an ongoing problem everywhere. The more drastic the weather changes between alternate freezes and thaws, the more wide-spread the problem becomes and the more time and money is spent by Local, State and Federal Governments in effecting repairs. At the present time, the usual method is simply to pour or shovel into the hole a mixture of sand or gravel and asphalt filling the hole to somewhat above street level and then tamping or rolling it into place. While this is effective initially, it is far from permanent and again depending on weather conditions and traffic volume, the patch tends to deteriorate by breaking up and working out of the hole. Prior art attempts to improve such repairs may be found in the following U.S. Pat. Nos. 3,699,854, 3,915,582, 4,074,948 and 4,113,401.

BRIEF SUMMARY OF THE INVENTION

It has been found that by a very simple expedient, pot hole patches can be made much more permanent. The problem with the conventional patch is that there is really nothing to hold it in place other than the adhesive effect of the asphalt acting between the patch and the bottom and sides of the hole. Generally speaking, the smaller the hole, the more difficult it is to patch it by conventional methods. By first firmly anchoring a loose mass of elongated flexible filaments to the bottom of the hole so that they substantially fill the hole and then filling the hole with conventional patching compound such as asphalt, the patch becomes a much more permanent repair because the patching compound unites permanently with the anchored filamentary material.

DETAILED DESCRIPTION OF THE INVENTION

Figure 1:
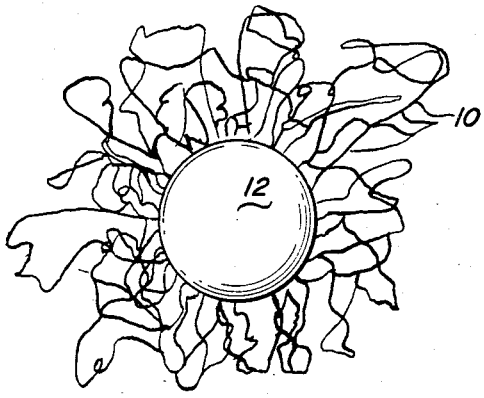
FIG. 1 shows one of the units, one or more of which are anchored in the hole prior to filling with patching compound.

Referring first to FIG. 1, a filler unit includes a plurality of elongated flexible randomly oriented filaments 10 which can be of any suitable material such as metallic wire, sisal fibers, synthetic resin filaments and the like. A mass of such filaments are held together at a single location preferably substantially the center of the mass by any convenient means such for example, by clamping between a pair of discs 12. The discs 12 may be metallic, wood or synthetic resin and they may be riveted, bolted or otherwise joined to each other to clamp the mass of filaments therebetween.

Figure 2:
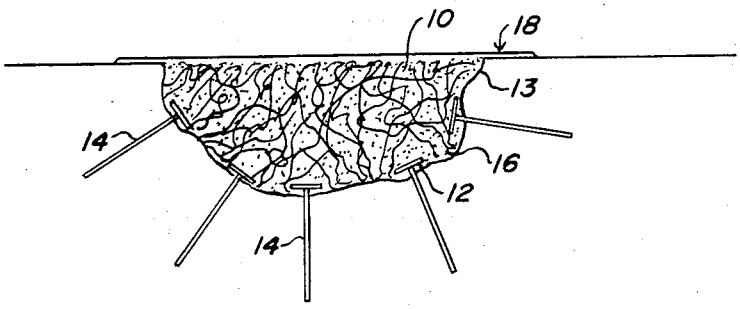
FIG. 2 is a vertical sectional view of a completed roadway patch.
Figure 3:
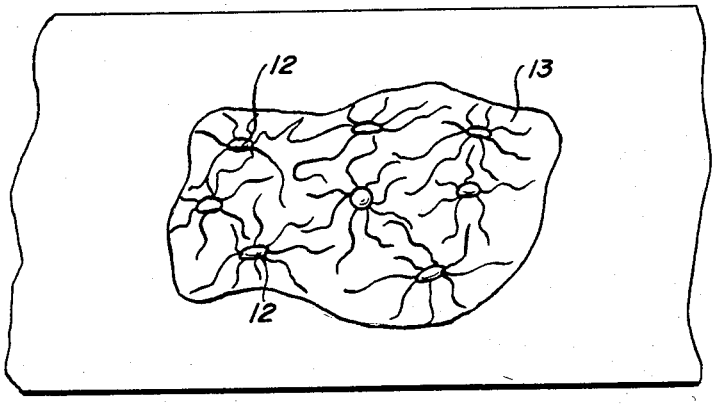
FIG. 3 is a top plan view of a pot hole with the prefilling material anchored to the bottom preparatory to filling with patching compound.

As indicated most clearly in FIG. 2, which shows a patch completed in accordance with the present invention, a plurality of these units shown in FIG. 1 are first anchored in the hole 13 by means of any form of elongated anchor members 14 such as nails, spikes, staples or the like driven through substantially the center of the disc 12. It is contemplated that the placing of the anchor members would be done using some form of gun which would "shoot" the anchoring members through the disc 12 and deep enough in to the ground to hold the device firmly in place. A sufficient number of these are placed in the hole so that the loosely inter-twined filaments loosely occupy the entire volume of the hole.

Following placing of these holding devices in the hole, the conventional patching step follows by pouring or shoveling an asphaltic patching compound 16 into the hole 13 and tamping or rolling to substantially the street level. As soon as the patch "sets up", the patching compound and the filamentary form unite in a manner which greatly increases the holding power of the finished patch as compared to a conventional patch.

If desired, a fabric or other mesh 18 may be placed over the patch and impregnated with asphalt prior to rolling or tamping so that it becomes a part of the finished patch and provides additional permanency by tending to seal the edges of the patch around the periphery of the hole.

While preferred embodiments of the present invention have been herein shown and disclosed, Applicant claims the benefit of a full range of equivalents within the scope of the appended claims.

I claim:

1. A method of repairing pot holes in streets and roadways, the steps comprising:

first, firmly anchoring a loose mass of randomly oriented flexible filamentary material to the bottom of the hole as to substantially occupy the volume of the hole with said loose mass of material;

second, filling the thus prepared hole with conventional road patching compound; and third, compacting the thus prepared patch to substantially street level.

2. The method of claim 1 in which said filamentary material comprises metallic wire.

3. The method of claim 1 in which said filamentary material comprises sisal fiber.

4. The method of claim 1 in which said filamentary material comprises synthetic resin.

5. A device useful in the patching of pot holes in streets and roads comprising:

a loose mass of randomly oriented flexible filaments; and clamping means securing said filaments together over a minor portion of the length of each filament to provide a unit which can be firmly anchored in the bottom of a pot hole by anchor means driven through said clamping means into the bottom of the hole.

6. A device as defined by claim 5 in which said filaments comprise metallic wire.

7. A device as defined by claim 5 in which said filaments comprise sisal wire.

8. A device as defined by claim 5 in which said filaments comprise a synthetic resin.

* * * * *